US005924645A

United States Patent [19]

Oshiumi

[11] Patent Number: 5,924,645

[45] Date of Patent: Jul. 20, 1999

[54] WINDING CONTROL DEVICE FOR A TAKE-UP WINDER

[75] Inventor: Koichiro Oshiumi, Kyoto, Japan

[73] Assignee: Murata Kikai Kabushiki Kaisha, Kyoto, Japan

[21] Appl. No.: 09/019,690

[22] Filed: Feb. 6, 1998

[30] Foreign Application Priority Data

Feb. 26, 1997 [JP] Japan ..... 9-041291

[51] Int. Cl.[6] ..... B65H 54/42

[52] U.S. Cl. ..... 242/486; 242/486.3

[58] Field of Search ..... 242/486, 486.3, 242/486.7, FOR 103

[56] References Cited

U.S. PATENT DOCUMENTS 4,548,366 10/1985 Wirz et al. ..... 242/486
4,765,552 8/1988 Sugioka et al. ..... 242/486

FOREIGN PATENT DOCUMENTS 7-172692 7/1995 Japan .

*Primary Examiner*—Michael Mansen
*Attorney, Agent, or Firm*—Armstrong, Westerman, Hattori, McLeland & Naughton

[57] ABSTRACT

A winding control device for a take-up winder that can reliably and precisely eliminate the slips of a contact roller rotated in contact with a bobbin holder used in a spindle-driven winding machine for synthetic yarn is described. The winding control device includes an induction motor IM3 which supplements the driving of the contact roller CR which rotates in contact with a package P. A counter force detector 7, 8 or 13 which detects the counter force created by the rotation of the contact roller against the bobbin holder, and a control part eliminates slips by adjusting the relative rotation speeds of the bobbin holder BH1 and the contact roller CR based on the output of the counter force detecting means 7, 8 or 13.

6 Claims, 3 Drawing Sheets

WINDING CONTROL DEVICE FOR A TAKE-UP WINDER

FIELD OF THE INVENTION

The present invention relates to a control device for a spindle-driven take-up winder, and more specifically, a device that minimizes the slips of a contact roller rotated in contact with a package or bobbin on a bobbin holder.

BACKGROUND OF THE INVENTION

A take-up winder is a machine that winds a synthetic yarn produced by a spinning machine onto a package around the surface of a bobbin inserted into a bobbin holder. There are two types of such take-up winders, a friction-driven type that drives the rotation of a friction roller rotated in contact with a package, and a spindle-driven type that drives the rotation of a bobbin holder. In the spindle-driven type, the package forms with the yarn let out at a fixed speed from the spinning machine and, as the diameter of the package slowly becomes larger, control is required in order to gradually reduce the rotation speed of the bobbin holder and maintain a constant winding speed.

In order to control the rotation speed of the bobbin holder, a contact roller is provided which rotates in contact with the bobbin or package while exerting a fixed pressure and, at the same time, detecting the peripheral rotation speed of the package. By detecting the rotation speed of the contact roller, the peripheral speed of the package is determined, and this peripheral speed is then compared to the preset peripheral speed in order to control the speed of the bobbin holder and keep the package winding speed constant. The contact roller in this kind of spindle-driven take-up winder, which rotates in contact with the bobbin or package, has a tendency to slip, necessitating control of the rotational speed of the bobbin holder to account for these slips. However, at high winding speeds, the slips can be very large and vary greatly. Since the winder is operated at a speed that corresponds to the peripheral speed of the contact roller, when a slip occurs, the peripheral speed detected is slower than the real peripheral speed of the package. The yarn is thus wound more tightly, increasing yarn tension, and thereby causing the package to bulge or otherwise become misshapen.

Assisted driving of the contact roller has been implemented to solve this problem. To create this assisted drive, conventional winding machines may use a torque motor. A torque motor has the unique ability to decrease rotation speed when torque is large, and to increase rotation speed when torque is small. Thus, when there is a large slip of the contact roller, the contact roller's torque motor receives a relatively large amount of drive force, the load torque is reduced, and the rotation speed is increased. On the other hand, when the slip is created by the contact roller's overdriving of the package, the load torque is increased, and the rotation speed is thus decreased. Thus the torque motor is able to control the rotation speed and eliminate the slip in either event.

Conventional winders may also use an inverter-controlled variable speed motor to assist the drive of the contact roller. This variable speed motor, creating almost burdenless drive, drives the contact roller at a rotation speed calculated as a function of the rotation speed of the contact roller when it is driven only by the contact roller, the appropriate spread of the torque value from the bobbin holder to the contact roller, and the number of packages being formed.

However, both of these conventional solutions have deficiencies. Driving the contact roller by means of a torque motor does not permit precise control of the slips, and driving the contact roller by means of a variable speed motor which rotates the roller at speeds according to a predetermined fixed function means that, whenever the specifications of the machine are changed, the fixed function of the variable speed motor mist also be changed accordingly.

SUMMARY OF THE INVENTION

The present invention takes into account these problems of the conventional technology with the object of providing a winding control device used in a spindle-driven winder that can reliably, and with a high degree of precision, reduce the slipping of a contact roller rotated in contact with a bobbin holder.

In order to solve the above-mentioned problems, the present invention is a control device for a take-up winder comprising a bobbin holder that is driven to rotate so as to form a package; a contact roller that rotates in contact with the package; a motor which supplements the drive of the contact roller; a detecting means for detecting slips created by the rotation of the contact roller with the bobbin holder; and a controlling part that eliminates the slip by changing the difference in the relative rotation speeds of the contact roller and the bobbin holder based on the output of the detecting means. It should be noted that detecting the slip as counter force, that is a force which the contact roller receives from the package, is preferable.

It is possible to achieve precise control and virtually eliminate the slip created between the contact roller and the package by directly detecting the slips as counter force of a motor which helps drive the contact roller.

According to the present invention, the motor is a variable speed motor, and the control part eliminates the slips by changing the speed setting at which the motor drives the contact roller.

Further, the control part also eliminates the slips by changing the speed setting at which the motor drives the bobbin holder.

Still further, the motor is supported so as to be able to freely rotate, and the counter force detection means measures the rotation force (load torque) borne by the motor.

Further still, the motor is a direct current motor in which the torque output and the current value are in proportional relation, and the counter force detection means measures the input current value of the direct current motor.

DETAILED DESCRIPTION OF THE PREFERRED EMBODIMENTS

Preferred embodiments of the present invention will now be explained in reference to the accompanying drawings.

Figure 1:
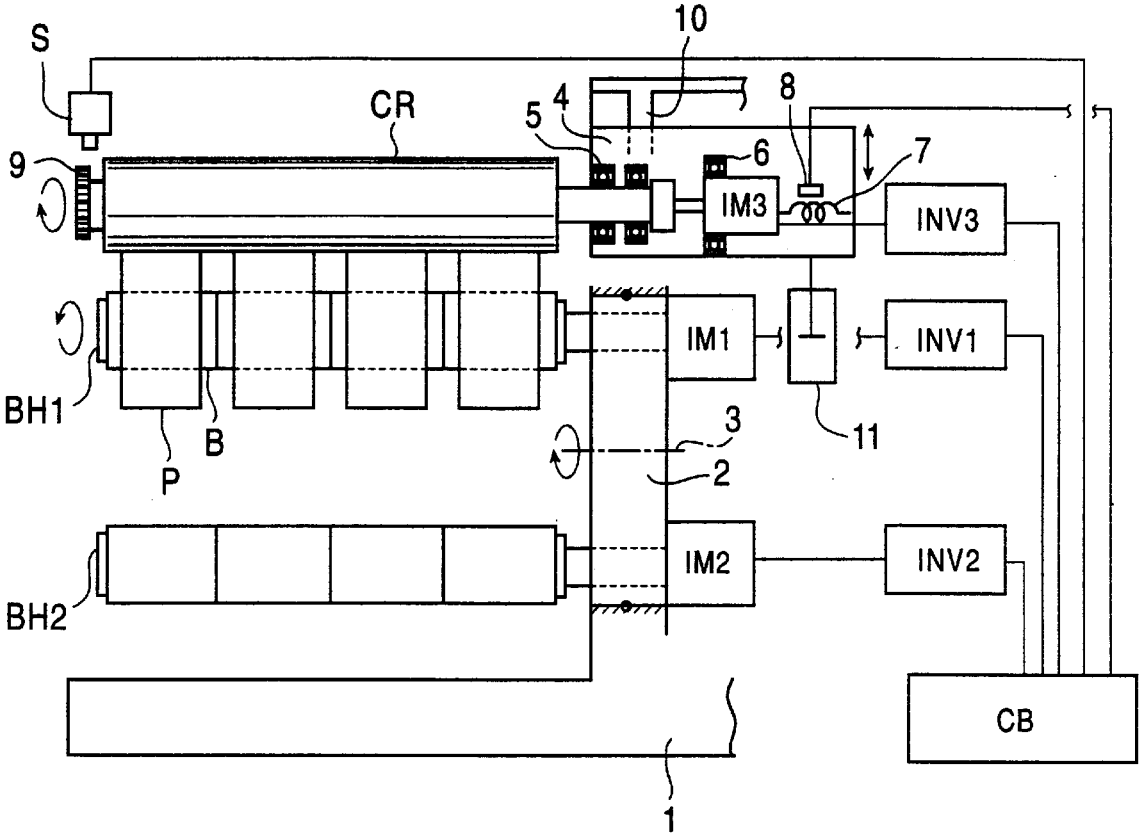
FIG. 1 is a block diagram of an embodiment of the winding control device for a take-up winder according to the present invention.

In FIG. 1, the take-up winder winds a plurality of synthetic yarns simultaneously, but to keep the present description simple, a winder which winds only four packages is herein explained.

The take-up winder comprises a machine frame 1 which supports a turret 2 so that it can freely rotate around a central axis 3, and the turret 2 of which is provided with two bobbin holders BH1, BH2, which can also rotate freely. Further, a contact roller CR exerts a fixed pressure against a package P which is formed by winding a yarn around a bobbin B inserted onto the bobbin holder BH1 which is set in the winding position.

The contact roller CR is held against an elevating member 4 so that it can be freely rotated by means of bearings 5. An induction motor IM3 which assists the rotation of the contact roller CR is also held against the elevating member 4 so that it can be freely rotated by means of a bearing 6. The load borne by the induction motor IM3 turns into rotational force (torque) as counter force which is balanced by a spring member 7, and becomes detectable by means of a strain gauge 8 which operates an the spring member 7. Further, a gear member 9 is attached to the end of the contact roller CR, and a sensor S is arranged so as to detect the teeth of the gear member 9.

The contact roller CR, which juts out from the elevating member 4, freely rotates. The elevating member 4 is arranged so that it can rise along a guide shaft 10, and is comprised so as to exert a fixed amount of a pressure equal to the difference between the lifting force of a pressure applying cylinder 11 and the weight of the contact roller CR unit against the package P.

The two bobbin holders BH1, BH2 are provided with rotational drive by induction motors IM1 and IM2, respectively. Inverters INV1, INV2, which output an alternate current with frequencies corresponding to the rotation speed of the induction motors IM1, IM2, drive the bobbin holders BH1, BH2 and are controlled by a control box CB. The rotation speed of the contact roller CR is detected by the sensor S, and the rotation speed of the induction motor IM1 of the bobbin holder BH1 in the winding position is controlled such that the rotation speed of contact roller CR is made constant, and such that the rotation speed of the induction motor IM1 is reduced as the diameter of the package P grows larger.

The contact roller CR, which rotates in contact with the package P formed on the bobbin holder BH1, is rotated with the assisted drive from the induction motor IM3.

When the rotational speed generated by this assisted drive is insufficient, a slip is generated between the package P and the contact roller CR. This slip increases the load, and is further imparted to the contact roller CR as a counter force, and turned into spring force across the spring member 7 such that it causes the case of the induction motor IM3 to move. This counter force is detected by the strain gauge 8 of the spring member 7. In order to reduce the level of the counter force, the synchronous rotational speed of the induction motor IM3 which drives the contact roller CR is adjusted, the slip created between the package P and the contact roller CR virtually disappears, and the peripheral speed of the contact roller CR and the winding speed are kept equal.

Figure 2:
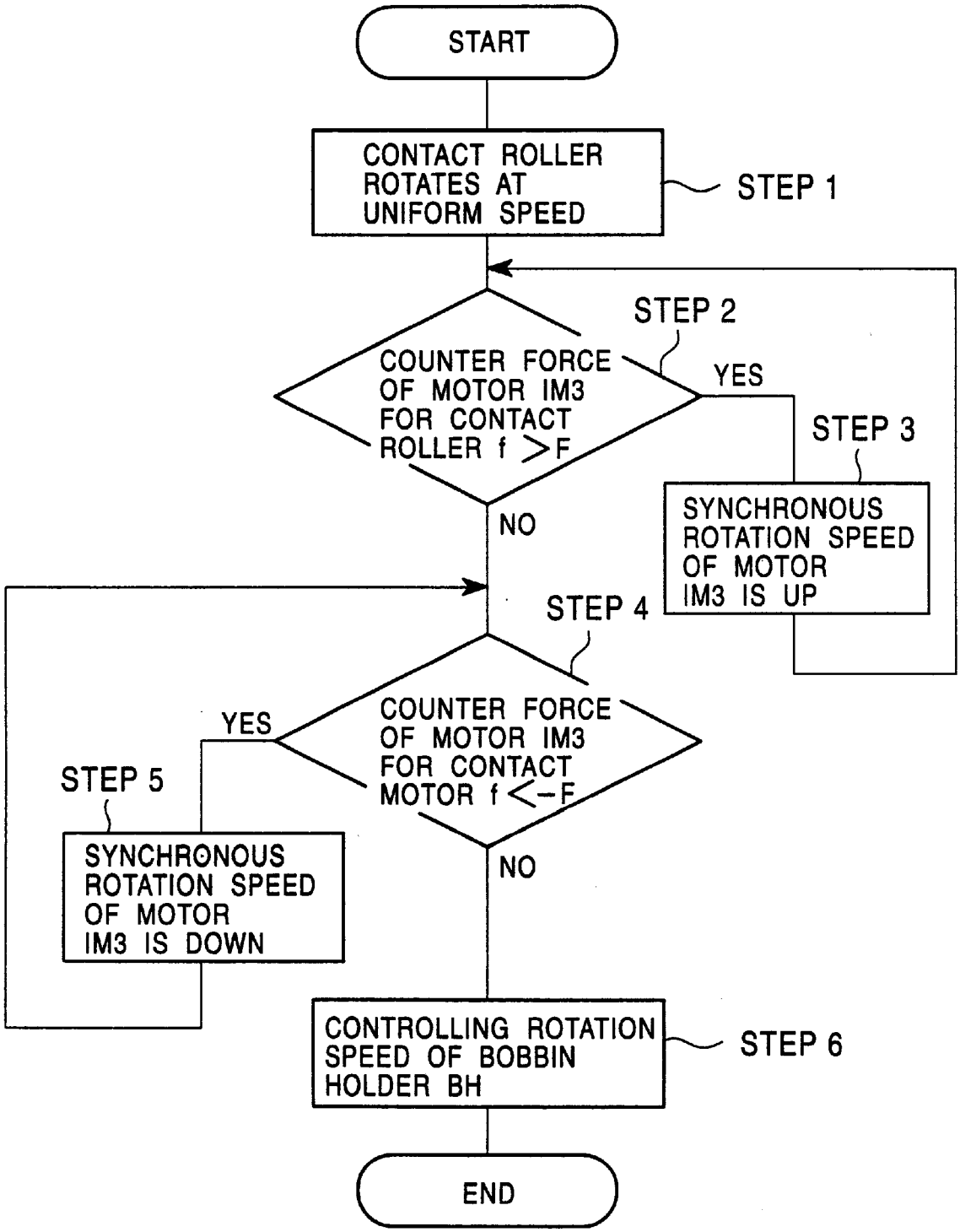
FIG. 2 is a flow chart diagram of the winding control device for a take-up winder shown in FIG. 1.

Next, the control flow chart of the contact roller CR which is implemented by a microprocessor provided in the control box CB will be explained in reference to FIG. 2.

Step 1 begins with the contact roller CR being caused to rotate with the bobbin B, and being driven such that it rotates at a uniform peripheral speed.

If the counter force f of the induction motor IM3 which drives the contact roller CR is greater than the fixed value F (step 2, YES), then the rotation speed setting sent by the inverter INV3 to the induction motor IM3 (the synchronous rotational speed of the induction motor IM3) is increased, and the slip is eliminated (step 3).

If the counter force f of the induction motor IM3 is not greater than the fixed value F (step 2, NO), it is determined whether or not the counter force f of induction motor IM3 is less than the fixed value −F (step 4). If the counter force f is less than fixed value −F (step 4, YES), then the rotation speed setting sent by the inverter INV3 to the induction motor IM3 is decreased, and the slip is eliminated (step 5). Hence, the rotation speed at which the induction motor IM3 which assists the drive of the contact roller CR is set, is adjusted within the fixed value limits of the counter force received from the package P, slips between the contact roller CR and the bobbin holder BH are continually eliminated, and the flow chart ends with the rotation speed of the bobbin holder BH being controlled and slowly reduced in accordance with the gradual increase in the diameter of the package P (step 6).

As described above, when the counter force exerted on the contact roller CR from the package P or the bobbin B of the bobbin holder BH is maintained within this range, the peripheral speed of the contact roller CR and the package P are kept completely equal, virtually eliminating slippage, and thus maintaining a fixed winding speed.

The winding control in the above described embodiment is achieved by means of changing the rotation speed setting of the motor which drives the contact roller CR, but control by means of changing the rotation speed setting of the motor which drives the bobbin holder BH is also possible.

Further, a slip detection means which detects the counter force borne by the induction motor IM3 of the contact roller CR was described, but detection of the torque borne by the contact roller CR is also possible.

Figure 3:
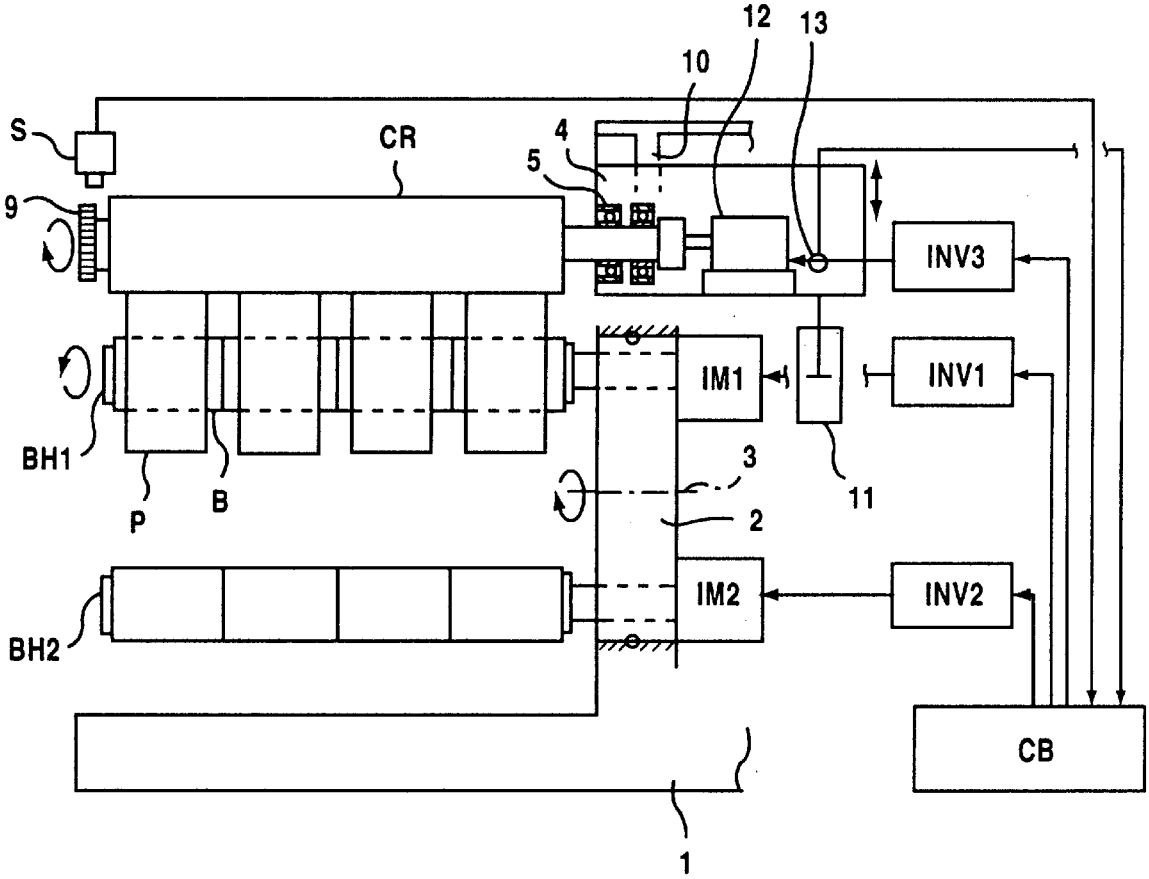
FIG. 3 is a block diagram of an alternative embodiment of the winding control device for a take-up winder shown in FIG. 1.

Also, as shown in FIG. 3, wherein like reference numerals corresponding to those used in FIG. 1 are employed, a DC brushless motor 12 that provides a drive proportional to the motor's output torque and input electric current may be used, and the counter force detection means 13 may then detect the current value of the DC brushless motor.

Since, as described above, control is accomplished such that the slip is eliminated in response to the detection of a slip of the contact roller CR against the package P, and since the slip can be reliably detected as a counter force, even if the specifications of the machine change, there is no need to adjust the slip control means, and slips can be reliably eliminated. As a result, the increase in winding tension caused by the slips can be completely eliminated.

By changing the rotation speed setting at which the motor drives the contact roller, slips can be eliminated without changing the peripheral speed of the package.

Further, by changing the rotation speed setting at which the motor drives the bobbin holder to eliminate slips, it becomes possible to achieve practical winding control by assisting the original rotation speed control means.

Still further, by detecting the torque borne by the motor driving the contact roller generated by the counter force of the slip, the counter force can be accurately and reliably detected. When the counter force of the slip is detected by the current value of the DC motor, it becomes easy to detect the counter force.

I claim:

1. A winding control device for a take-up winder comprising:

a bobbin holder which is provided with a rotational drive;

a bobbin inserted onto said bobbin holder around which a yarn is wound in order to form a package;

a contact roller which is rotated in contact with said package while exerting a fixed pressure on said package;

a motor which drives said contact roller;

a detecting means for detecting slips created by the rolling of said contact roller against said bobbin holder by detecting slips of the contact roller as a counter force;

a control part for controlling slips by adjusting the relative rotation speeds of the bobbin holder and the contact roller based on the output of said detecting means.

2. The winding control device for a take-up winder of claim 1 wherein:

said motor is a variable speed motor and said control part controls the slips by changing the rotation speed setting of said motor.

3. The winding control device for a take-up winder of claim 1 wherein:

said controlling means controls slips by changing the rotation speed setting of a motor which drives the bobbin holder.

4. The winding control device for a take-up winder of any one of claims 1, 2 and 3 wherein;

the motor is a direct current motor wherein the torque and current are maintained in proportional relation, and the slip detecting means detects the current value of the direct current motor as a counter force.

5. The winding control device for a take-up winder of any of claims 1, 2 and 3 wherein;

the motor is supported so as to rotate freely, and the slip detecting means detects the torque borne by said motor as a counter force.

6. The winding control device for a take-up winder of claim 5 wherein:

the motor is a direct current motor wherein the torque and current are maintained in proportional relation, and the slip detecting means detects the current value of the direct current motor as a counter force.

* * * * *